US009202641B2

(12) United States Patent
Berard et al.

(10) Patent No.: US 9,202,641 B2
(45) Date of Patent: Dec. 1, 2015

(54) ELECTRICAL EQUIPMENT COMPRISING A MOBILE PART HAVING IMPROVED DYNAMICS

(75) Inventors: David Berard, Villeurbanne (FR); Jean-Pierre Dupraz, Bressolles (FR)

(73) Assignee: ALSTOM TECHNOLOGY LTD., Baden (CH)

( * ) Notice: Subject to any disclaimer, the term of this patent is extended or adjusted under 35 U.S.C. 154(b) by 56 days.

(21) Appl. No.: 13/978,909

(22) PCT Filed: Feb. 2, 2012

(86) PCT No.: PCT/EP2012/051752

§ 371 (c)(1), (2), (4) Date: Jul. 10, 2013

(87) PCT Pub. No.: WO2012/104371

PCT Pub. Date: Aug. 9, 2012

(65) Prior Publication Data

US 2013/0299320 A1 Nov. 14, 2013

(30) Foreign Application Priority Data

Feb. 2, 2011 (FR) ..... 11 50817

(51) Int. Cl.

| | |
|---|---|
| ***H01H 9/28*** | (2006.01) |
| ***H01H 1/50*** | (2006.01) |
| ***H01H 3/50*** | (2006.01) |
| ***H01H 3/60*** | (2006.01) |
| ***H01H 33/666*** | (2006.01) |

(52) U.S. Cl.

CPC . *H01H 1/50* (2013.01); *H01H 3/50* (2013.01); *H01H 3/60* (2013.01); *H01H 33/666* (2013.01)

(58) Field of Classification Search

CPC ..... H01H 3/3031; H01H 3/3052; H01H 2003/3036; H01H 3/30; H01H 9/28; H01H 1/12; H01H 3/00; H01H 3/02; H01H 3/3042; H01H 5/00; H01H 5/18; H01H 5/20; H01H 5/22; H01H 5/28; H01H 5/30; H01H 17/00; H01H 17/06; H01H 17/14; H01H 17/16; H01H 17/26; H01H 17/28; H01H 2003/00; H01H 2003/02; H01H 2003/22; H01H 2003/46; H01H 2003/463; H01H 2013/00; H01H 2013/50; H01H 2013/525; H01H 2235/00; H01H 2235/006; H01H 2235/012; H01H 2235/014; H01H 2235/028; H01H 2235/026; H01H 2235/03; H01H 2237/004; H01H 2237/008; H01H 2237/006; H01H 35/02; H01H 21/54; H01H 39/00; H01H 79/00

USPC ..... 200/43.16, 402, 400, 407, 431, 445, 200/447, 456, 460–462, 472

See application file for complete search history.

(56) References Cited

U.S. PATENT DOCUMENTS

| | | | |
|---|---|---|---|
| 2,899,837 | A | 8/1959 | Skarren |
| 3,445,613 | A | 5/1969 | Louzil et al. |

(Continued)

FOREIGN PATENT DOCUMENTS

| | | | |
|---|---|---|---|
| DE | 2708082 | A1 | 8/1978 |
| EP | 1583119 | A2 | 3/2005 |

(Continued)

OTHER PUBLICATIONS

International Search Report for application PCT/EP2012/051752 dated May 4, 2012.

(Continued)

*Primary Examiner* — Edwin A. Leon
*Assistant Examiner* — Anthony R. Jimenez
(74) *Attorney, Agent, or Firm* — Pearne & Gordon LLP

(57) ABSTRACT

A locked state for a movable part (11) of switchgear is created by deflected spring wires (15) entering a recess (12). Said device is reversible and has the advantage of being safe since it is completely passive, and it improves the dynamics of the movement of the movable part in particular by damping impacts when entering the abutment state. The invention can be applied to the drive rod of a vacuum circuit-breaker.

19 Claims, 5 Drawing Sheets

(56) References Cited

U.S. PATENT DOCUMENTS

| | | | |
|---|---|---|---|
| 3,908,473 | A | 9/1975 | Bussen et al. |
| 2009/0141416 | A1 | 6/2009 | Dommaschk et al. |

FOREIGN PATENT DOCUMENTS

| | | | |
|---|---|---|---|
| EP | 1583119 | A2 | 10/2005 |
| EP | 2141720 | A1 | 1/2010 |
| EP | 2261942 | A2 | 12/2010 |
| FR | 2461347 | | 7/1979 |
| FR | 2461347 | A1 | 1/1981 |
| GB | 1585437 | | 4/1978 |
| WO | 2007/095873 | A1 | 8/2007 |

OTHER PUBLICATIONS

International Search Report, PCT/EP2012/051760, dated May 16, 2012.

ELECTRICAL EQUIPMENT COMPRISING A MOBILE PART HAVING IMPROVED DYNAMICS

The invention relates to switchgear including a movable portion, that is used in particular for causing a circuit of the switchgear to pass either from an open state to a closed state, or from a closed state to an open state of the same circuit and in which the movement dynamics are improved. A preferred device for which the invention could find a use is a vacuum circuit-breaker.

Figure 1:
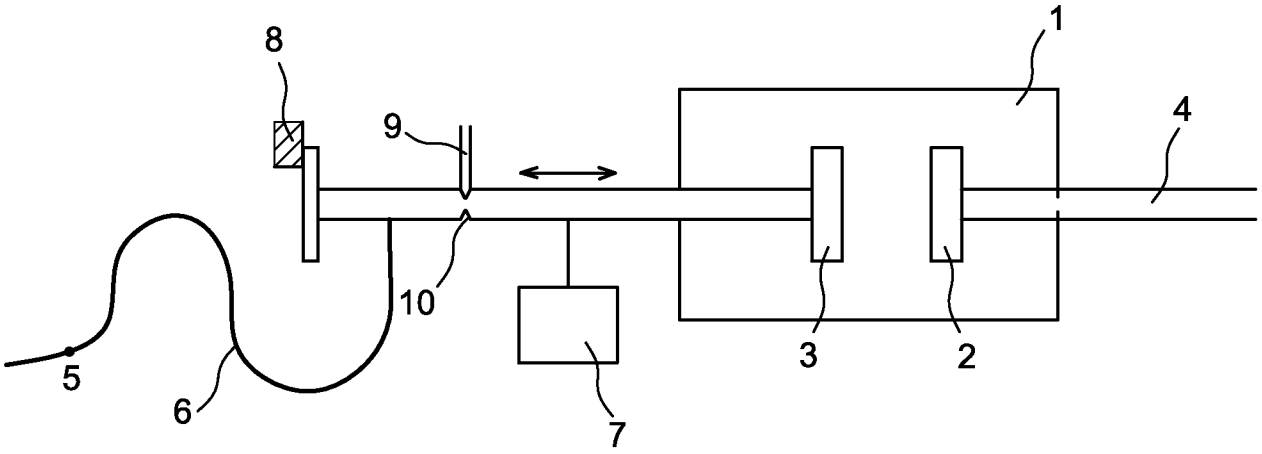

Firstly, a vacuum circuit-breaker of known type is described below. As shown in FIG. 1, such a vacuum circuit-breaker comprises, in a casing (1), a stationary portion (2) and a movable portion (3) that have a state of mutual electrical connection in which they are in contact and a state of disconnection in which they are separated. The stationary portion (2) is joined to a conductor (4) passing through the casing (1), and the movable portion (3), which itself passes through the casing (1), is connected to another conductor (5), for example by a device such as a flexible braid (6). The conductors (4 and 5) are connected to an arbitrary circuit that is not shown. A movement device (7), that is capable of being of a wide variety of shapes, moves the movable portion (3). A stationary abutment (8) defines the open state by stopping movement of the movable portion (3).

Devices of that kind are subjected to various problems that are listed below. For safety reasons, it may be useful to maintain the switchgear in one of its states, e.g. in the open position for a vacuum circuit-breaker, and locking means are thus used in addition to or as a replacement for the abutment (8). Such means may comprise a blade (9) engaging in a recess (10) of the movable portion (3) when the corresponding position is reached. A drawback is thus that an independent mechanism should in principal be used for initiating or interrupting locking, and that increases the system's response time because of the need to remove the blade (9) prior to a closing operation. An example is given in document U.S.-A-2009/0 141 416 in which the lock-actuating device is a pyrotechnic device which also makes it unsuitable for repeated use. Circular springs that are capable of tightening in order to enter a recess (12) and establish a mechanical connection have also been proposed in switchgear, but firstly positioning accuracy is not very good, and secondly the springs risk being broken by the repeated and back-and-forth friction on the movable portion (3) when they are used in systems of small size. Mention can be made of the products Ballatch from Bal Seal and Omni Spring from Saint Gobain, in which the springs are made from a helical spring forming a closed loop.

However, reliable locking means are even more necessary in a vacuum circuit-breaker, since the pressure difference between the outside and the inside of the casing (1) exerts a force that tends to move and hold the movable portion (3) towards its closed position and can therefore force the closed state in the event of locking failure.

Another difficulty comes from the energy of impacts at the end of movements, when an abutment is reached: that can present dangers for the switchgear as a whole, since the parts are often small and delicate.

Good control of the forces produced when changing state is also desirable in order to guarantee better holding in the desired position. The main object of the invention is therefore to improve the characteristics of the movement dynamics of the movable portion during changes of state, in particular by means of an improved locking mechanism, whenever the movable element reaches or leaves the locked state. Among other things, a passive locking system is desired that is well calibrated, e.g. to withstand the aerostatic force that is due to the pressure difference while automatically giving way when a greater force is applied to the movable portion, i.e. a force for starting the movement device. The locking device is also provided with a good ability to absorb impacts when the locking position is reached. In certain particular embodiments of the invention an application force is exerted on the movable portion in the state in which the vacuum circuit-breaker is closed, the stationary portions and movable portions being in contact, in such a manner as to improve the electrical contact resistance between said two portions. The electrical connection between the movable portion and the conductor that is connected thereto is made particularly carefully, as described below.

In general, the invention relates to switchgear comprising a movable portion provided with a recess and a locking part, called a "lock", which, when it is unlocked, slides relative to the movable portion, and when in its locked position, penetrates into said recess when the movable portion reaches the domain corresponding to the first stable state of the vacuum circuit-breaker, called the "open" state. The movable portion is characterized by a suitable profile including a recess defined on either side by conical zones, one of said zones being suitable for being associated with a shoulder. The locking part comprises at least one spring wire that extends between two supports on either side of the movable portion and that is deflected by the movable portion.

Figure 2A:
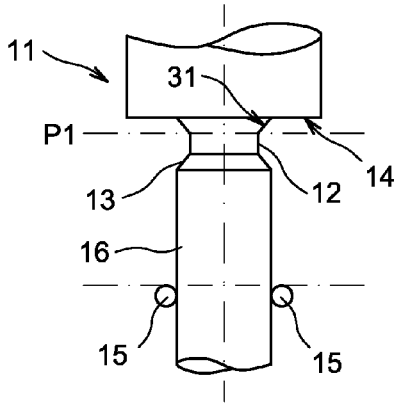
Figure 2B:
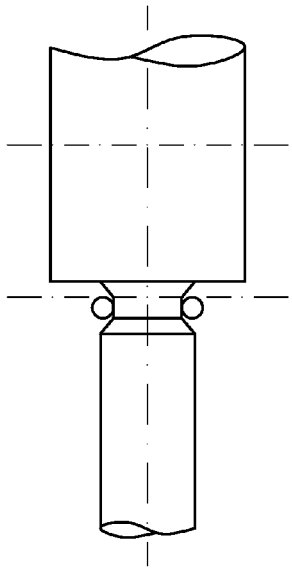
Figure 2C:
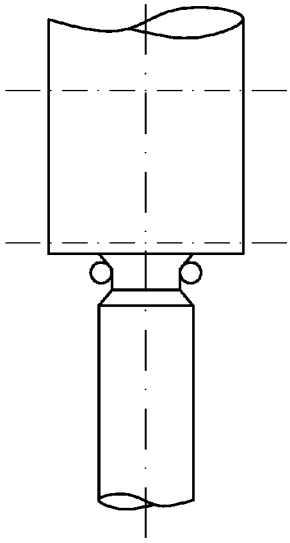
Figure 3B:
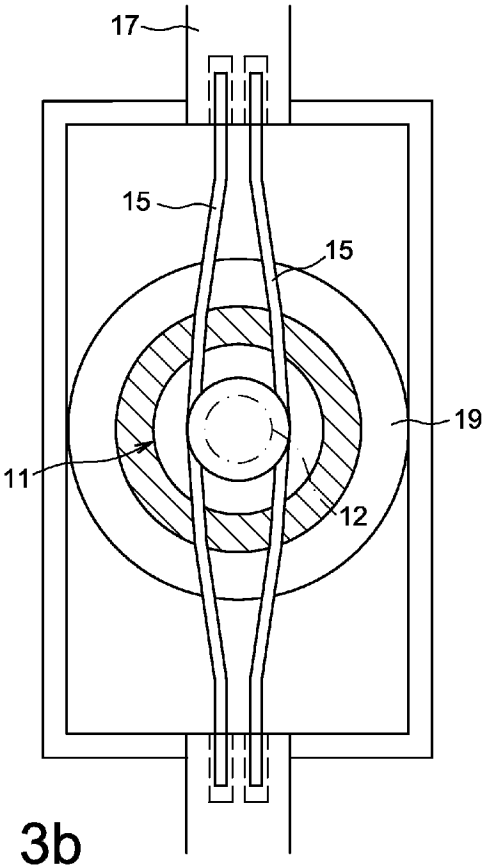
Figure 3A:
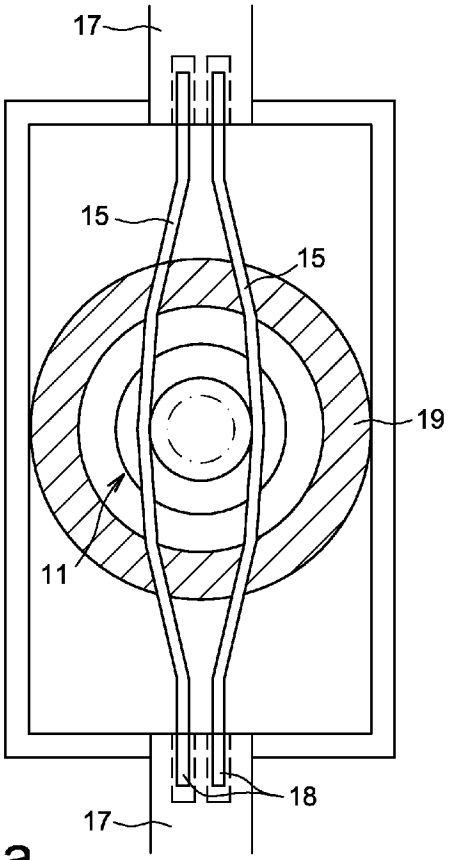
Figure 4A:
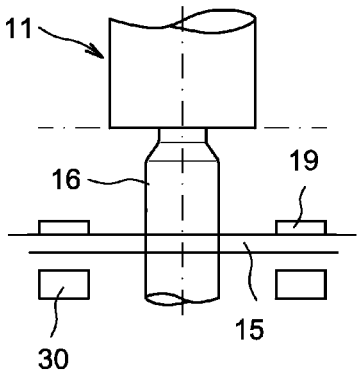
Figure 4B:
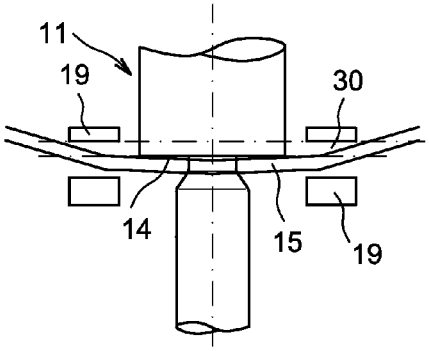
Figure 5:
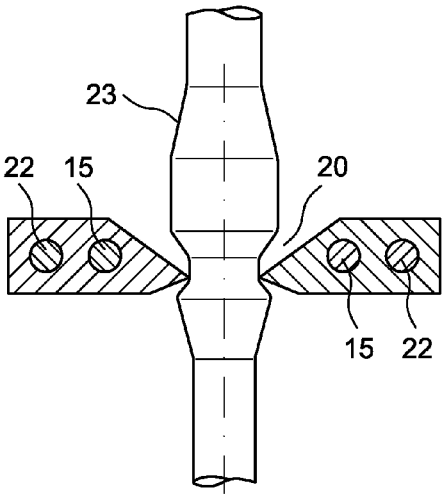

The invention is described below in its various aspects by means of the following figures, in which:

FIG. 1, described above, shows a vacuum circuit-breaker;

FIGS. 2*a*, 2*b*, 2*c*, and 2*d* show the movable portion of an illustrative embodiment of the switchgear of the invention in four positions: unlocked, passing the lock, extreme overtraveling of the lock, and the lock in a stabilized position, corresponding respectively to the "closed", "passing", "overtravel" and "open" states;

FIGS. 3*a* and 3*b* are views of the axially-movable portion in the states of FIGS. 2*a* and 2*b* respectively;

FIGS. 4*a* and 4*b* show another element of the switchgear;

FIG. 5 shows a variant embodiment; and

Figure 6A:
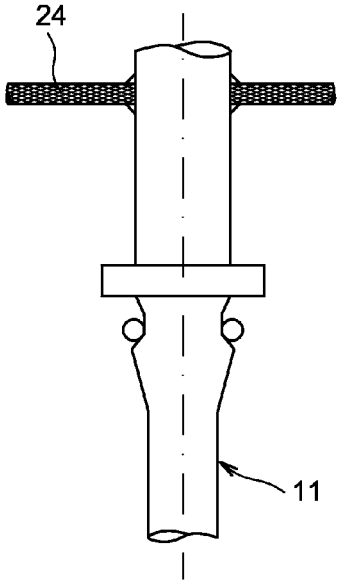
Figure 6B:
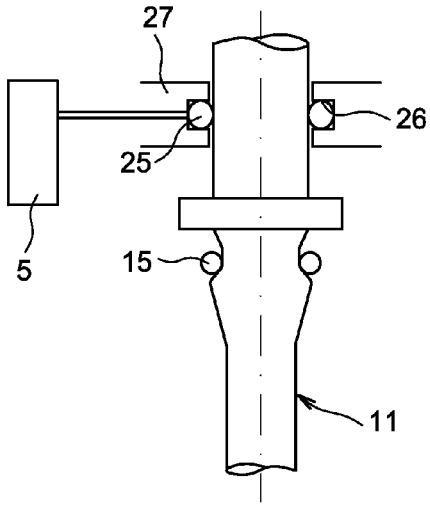
Figure 6C:
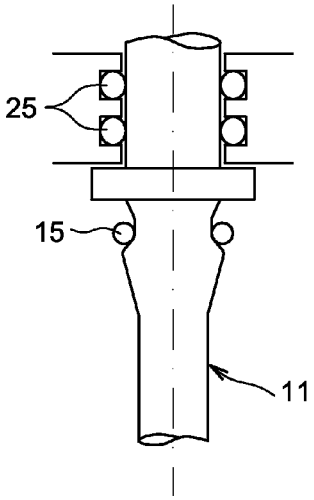

FIGS. 6*a*, 6*b*, and 6*c* show additional arrangements of the electrical connection.

Initially, reference is made to FIGS. 2*a* and 3*a*. The movable portion of the invention, now given the reference (11), now further includes a recess (12), but that is limited on one side by a conical face (13) and on the other by a plane shoulder (14) preceded by a conical zone (31) in which the diameter of the movable portion (11) increases progressively towards the shoulder (14). The device further comprises two spring wires (15) (a single wire could suffice) rubbing against a cylindrical zone (16) of the movable portion (11) and extending relative to the recess (12), on the same side as the conical face (13). The spring wires (15) are metal springs of the "piano wire" type, and they extend perpendicularly to the movement axis of the movable portion (11). They are deflected and moved apart from each other by contact with the cylindrical zone (16). Their extension plane is indicated by the line P1. Their ends engage in holes (18) of supports (17) to an extent that varies, and they are capable of sliding therein with friction that is non-negligible.

They are held in a common plane, the holes (18) and the profile of the movable portion (11) being dimensioned in such a manner as to deform them elastically in such a manner that they exert a radial force on the cylindrical zone (16) of the movable portion (11).

Figure 2D:
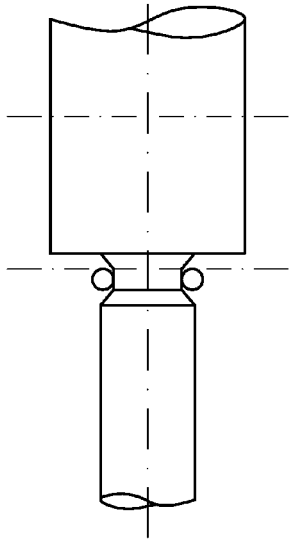

When the movable portion (11), initially stabilized in the closed position as shown in FIG. 2*a* if the switchgear is a vacuum circuit-breaker, is moved downwards in order to reach the locked position of FIG. 2*d*, which corresponds to the open state if the switchgear is a vacuum circuit-breaker, the spring wires (15) enter the recess (12) by means of the radial force due to the bending that is applied to them, and that is shown in FIGS. 2*b* and 3*b*. An additional movement of the movable portion (11), similar to overtravel, is counteracted by the tapering of the conical zone (31), as a result of a transfer of energy from the movable portion (11) towards the spring wires (15), and then, if any kinetic energy remains in the movable portion (11), movement is stopped by the shoulder (14). During these two overtravel stages, the spring wires (15) are pushed down and for a short instant they cease (but in resilient and reversible manner) to be co-planar (departing from the line P1), giving the state in FIG. 2*c*, where the locking position is temporarily exceeded to a greater or lesser extent as a result of said bending, thereby having the advantage of damping the impact on coming into abutment. The amplitude of said movement is limited by an abutment system (30). The device then returns in stable manner to the position shown in FIG. 2*d*.

The movable portion (11) moves out of abutment by moving in the opposite direction. The spring wires (15) move out of the recess (12) by sliding on the conical face (13), without any additional means, being used in order to promote the spacing apart of the spring wires (15) other than the force applied to the movable portion (11). The reversible character of this passive mechanism can however be improved by using the device shown in FIGS. 3*a*, 3*b*, and 4*a*: an annular ring (19) surrounding the movable portion (11) serves to support the spring wires (15) relative to the recess (12) in the same direction as the shoulder (14), and therefore prevents the spring wires (15) from bending in that direction, thereby enabling the spring wires (15) to move out of the recess (12) steadily, without any sudden relaxation. Another advantage of the annular ring (19), and of the way it holds the spring wires (15), is that the abutment position is defined accurately, even when force continues to be applied at rest to the movable portion (11), such as the aerostatic force on a vacuum circuit-breaker. For the record FIG. 4*b* shows the bending of the spring wires (15) in the position shown in FIG. 2*c*. An additional abutment system (30) is added in order to limit bending of the spring wires (15) due to the movement of the movable body.

FIG. 5 shows a few possible improvements that are suitable for being adopted, separately or together. Initially, the spring wires (15) themselves need not penetrate into the recess, if they are accompanied by blades (20) to which they transmit the force due to bending, said blades, which are inserted between the recess (12) and the central zones of the spring wires (15), rubbing against the movable portion (11). The blades (20) may be shaped to form points (21) that penetrate into the recess (12) by being suitable for occupying its entire width, resting on one side against the shoulder (14) and on the other side against the conical face (13). This double support guarantees the position of the movable portion (11) with very great accuracy in the locked state. Each tip (21) has dimensional properties, rounded shape, etc. that are found to be the best for making locking and unlocking convenient. However, operation is not modified, the spring wires (15) being deflected and locking taking place by means of them straightening out partially when the blades (20) arrive at the recesses (12). In this design, other spring wires (22) can participate in creating the locking force and in maintaining the orientation of the blades (20), which are also mounted thereon; said additional wires (22) are constituted in the same way, have the same shape and the same properties as the spring wires (15). As shown in FIG. 5, they can be in alignment with the spring wires (15) along an axis that is perpendicular to the movement axis of the movable portion (11). Another improvement is represented by a conical zone (23) of the core (16) flaring towards the recess (12) and having the function of creating an axial force component on the movable portion (11) when the tightening of the spring wires (15) exerts itself on said conical zone (23), so as to constrain the movable portion (11) towards the other main state of the switchgear (the closed state for vacuum circuit breakers) in order to better stabilize and improve the electrical contact resistance between the two portions (2, 3), by reinforcing the aerostatic force when it exists and by correcting the consequences of gaps or friction in the switchgear. The position of the conical portion (23) is chosen so that the spring wires (15) or the blades (20) are on said conical portion when the "closed" state of the switchgear is reached.

Another aspect of the invention is explained below. FIGS. 6*a*, 6*b*, and 6*c* show that the electrical connection between the movable portion (11) and its conductor (5) can be provided by a conductive metal braid (24) similar to the braid (6), that is crimped, welded, or soldered to the movable portion (11) outside the spring wires (15); by a circular spring (25) formed by rolling up a helical spring made of conductive material, and that is housed in a recess (26) of a support (27), a conductive connection existing between the spring (25) and the conductor (5); or by a plurality of such springs (25) arranged in parallel in the recesses in the vicinity of the support (27). The first solution is more suitable for low-voltage electric switchgear, the others for medium- and high-voltage switchgear.

In various advantageous but optional arrangements, the movable portion (11) includes at least one axisymmetrical zone, or is even completely axisymmetrical, so that its orientation relative to spring wires (15) makes no difference. The radial force exerted on the movable portion (11) by the spring wires (15) is determined at will by appropriately selecting diameters, lengths, and kinds of wire, and also the diameters of the profile of the movable portion (11), the positions of the spring wires (15) at the supports (17), and therefore the spacing between them when there are a plurality of wires, which determines the bending exerted by the movable portion (11) on the spring wires (15), and the amount of friction. The abutments (29 and 30) define two mutually parallel planes, perpendicular to the movement axis of the movable portion (11), and spaced apart from each other by a distance that is greater than the diameter of the spring wires (15), said distance being chosen in such a manner as to allow the spring wires (15) to move along the movement axis of the movable portion (11) through an amplitude that is limited so that the spring wires (15) remain within their elastic range. Finally, the entire zone of the movable portion (11) against which the spring wires (15) are likely to rub has no sharp edges likely to weaken the spring wires (15) or the movable portion (11).

What is claimed is:

1. A switchgear including;

a movable portion (11) that is movable between two main states known as an open state and a closed state respectively, the movable portion (11) including a suitable profile including a recess (12) defined on either side by first and second conical zones (13, 31), one of said first and second conical zones being suitable for being associated with a shoulder (14); and a locking part against which the movable portion slides, wherein the locking part is urged towards the movable portion in such a manner as to penetrate into the recess when the recess is in front of the locking part, one of the main states, the open state then being reached, and the locking part comprises at least one spring wire (15) that extends between two supports (17) on either side of the movable portion and that is deflected by the movable portion, wherein the at least one spring wire and the recess both extend perpendicularly to a direction of movement of the movable position between the two main states.

2. The switchgear according to claim 1, wherein the movable portion (11) includes at least one axisymmetrical zone.

3. The switchgear according to claim 1, wherein the ends of the spring wire are engaged in the supports (17), with engagement in the supports being to a variable extent.

4. The switchgear according to claim 1, wherein a radial force exerted on the movable portion (11) is determined by selecting the diameter, length, and kind of the spring wire (15), and by selecting the profile diameters of the movable portion (11) and the position of the spring wire (15) in the supports (17).

5. The switchgear according to claim 1, further including an abutment (19) designed to limit movement of the spring wire (15) along which the movable portion (11) moves and in a direction corresponding to an action of moving the movable portion towards the closed state.

6. The switchgear according to claim 5, further including an abutment (30) designed to limit movement of the spring wires (15) along which the movable portion (11) moves towards the open state.

7. The switchgear according to claim 6, wherein the abutments (19) and (30) define two mutually-parallel planes, perpendicular to the movement axis of the movable portion (11) and spaced apart from each other by a distance that is greater than the diameter of the spring wires (15), said distance being chosen in such a manner as to allow the spring wires (15) to move along the movement axis of the movable portion (11) through an amplitude that is limited so that the spring wires (15) remain within their elastic range.

8. The switchgear according to claim 1, further including a blade (20) mounted on the wire, the blade sliding on the movable portion and being suitable for penetrating into the recess.

9. The switchgear according to claim 8, further including a reinforcing and holding spring wire (22) on which the blade is also mounted.

10. The switchgear according to claim 8, wherein the blade (20) penetrates into the recess (12) by bearing both against the shoulder (14) and against the first conical zone (13).

11. The switchgear according to claim 1, further including a second spring wire (15) also extending between two supports on either side of the movable portion and deflected by the movable portion, the spring wires being essentially identical and substantially symmetrical on either side of the movable portion.

12. The switchgear according to claim 1, wherein the movable portion includes a third conical zone (23) flaring towards the recess, beside the first conical zone (13) and against which the wire (15) thrusts when the movable portion (11) reaches the closed state, the taper of the third conical zone (23) being oriented in such a manner that said thrust results in an axial force urging the movable portion (11) towards the closed state.

13. The switchgear according to claim 1, wherein an entire face of the movable portion (11) against which the spring wires (15) are likely to rub has no sharp edges likely to weaken the spring wires (15) or the movable portion (11).

14. The switchgear according to claim 1, wherein the movable portion (11) is fitted with a conductive braid (24) for connection to a stationary conductor (5).

15. The switchgear according to claim 1, wherein movable portion (11) is fitted with at least a conductive spring (25) that rubs thereagainst while being housed in a recess in a stationary element (9) providing the connection with the stationary conductor (5).

16. The switchgear according to claim 1, wherein the shoulder is in abutment for the spring wire in said direction of movement of the movable portion.

17. The switchgear according to claim 1, wherein the at least one spring wire is a straight piano wire type spring.

18. The switchgear according to claim 1, wherein the at least one spring wire comprises two end portions that are mounted on opposite sides of the moving portion and a middle portion that extends between the two end portions and engages the movable portion, further wherein the middle portion is deflected by the moving portion such that the middle portion is bent about a longitudinal axis of the moving portion.

19. The switchgear according to claim 18, wherein the recess is an annular recess and when the movable portion is in the open state, the middle portion of the at least one spring wire engages a partial circumferential portion of the annular recess such that the middle portion extends about the partial circumferential portion.

* * * * *